US010777044B2

(12) United States Patent
Mithani et al.

(10) Patent No.: US 10,777,044 B2
(45) Date of Patent: Sep. 15, 2020

(54) METHOD AND APPARATUS FOR A WAGER GAME WITH A RE-BUY BONUS FEATURE

(71) Applicant: Zydexo, Inc., Peachtree Corners, GA (US)

(72) Inventors: Akber Mithani, Duluth, GA (US); Evgeny Bronnikov, Buford, GA (US)

(73) Assignee: Zydexo, Inc., Peachtree Corners, GA (US)

( * ) Notice: Subject to any disclaimer, the term of this patent is extended or adjusted under 35 U.S.C. 154(b) by 27 days.

(21) Appl. No.: 16/125,202

(22) Filed: Sep. 7, 2018

(65) Prior Publication Data

US 2020/0082670 A1 Mar. 12, 2020

(51) Int. Cl.
*G07F 17/32* (2006.01)
*G07F 17/34* (2006.01)

(52) U.S. Cl.
CPC ..... *G07F 17/3267* (2013.01); *G07F 17/3251* (2013.01); *G07F 17/34* (2013.01)

(58) Field of Classification Search
CPC ..... G07F 17/3244; G07F 17/3262
See application file for complete search history.

(56) References Cited

U.S. PATENT DOCUMENTS

2002/0099608 A1* 7/2002 Pons ..... G06Q 20/04 705/21
2003/0027619 A1* 2/2003 Nicastro, Sr. ..... G07F 17/32 463/16
2015/0262450 A1* 9/2015 Elias ..... G07F 17/3262 463/25

* cited by examiner

*Primary Examiner* — David L Lewis
*Assistant Examiner* — Robert E Mosser
(74) *Attorney, Agent, or Firm* — Baker Botts L.L.P.

(57) ABSTRACT

The present invention relates to gaming systems and methods where a wager game may trigger a bonus round. A player may qualify for the bonus round at random or through satisfaction of some predetermined criteria. The player then participates in the bonus round, which may award bonus points at random or require the player to demonstrate skill, knowledge, or strategy to earn bonus points. Although a limited number of attempts in the bonus round may be awarded, the player has an option to re-buy attempts to continue enjoying the bonus round. Upon the satisfaction of certain criteria, which may include, but are not limited to, completion of the game or a decision by the player to end the bonus round, the player is returned to the original wager game.

23 Claims, 10 Drawing Sheets

METHOD AND APPARATUS FOR A WAGER GAME WITH A RE-BUY BONUS FEATURE

BACKGROUND OF THE INVENTION

Wager games, games in which players bet credits on rounds of the game, are a staple in the gaming community. One embodiment of a wager game is a slot machine. Like most wager games, the slot machine's underlying premise has held constant through its extensive history. Players insert some form of consideration and initiate the spinning of a plurality of reels containing a plurality of symbols, usually by pulling a handle or pressing a SPIN button. The reels spin for a few seconds and then stop one by one, revealing a pattern of symbols. If the pattern of symbols forms a winning combination along a pay line, the player receives some form of reward.

The historical consistency of wager games, like the slot machine, is almost paradoxically supplemented by a culture of experimentation that keeps the gaming experience novel and entertaining. In the case of the slot machine, the most obvious change has taken place in the gaming machine itself. Over time, slot machines have transformed from purely mechanical devices to electromechanical devices to purely electrical devices that can fit into a standalone machine or a phone application, among other forms. Slot machine inventors have utilized this progression to insert additional symbols and reels into the game, creating many more possible winning combinations.

Other changes have been made to the gameplay including skill-based wager games for entertainment purposes. For example, a variety of "second chance" features have been implemented in slot machines to increase the skill-based wager game's level of interactivity. In one embodiment, players can "nudge" a reel during a brief period of time after it has stopped spinning, potentially transforming a losing combination into a winning combination or vice versa. In another embodiment, players can "hold" one reel while re-spinning the others, accruing points for each consecutive combination that results.

One of the most alluring gameplay additions to skill-based wager games is the bonus. Bonuses can be triggered in many ways, from satisfying certain conditions to being randomly awarded, and can take the form of a random number generator bonus round ("RNG bonus round") or a skill-based bonus round.

In an RNG bonus round, players are rewarded a variable amount of bonus points, usually limited to one attempt per RNG bonus round triggered. Skill-based bonus rounds involve an entirely new game that temporarily interrupts the traditional slot machine gaming experience. In the skill-based bonus round, players are often given a certain number of attempts to accrue bonus points and complete the bonus round. When these attempts are exhausted, the player receives bonus points and then returns to the original skill-based wager game. Bonuses keep gameplay exciting by offering new ways to play the skill-based wager game. However, once the attempts for a bonus round are exhausted, the bonus is finished; the player must trigger another bonus to return to the bonus round.

Although a slot machine is used as an example of a skill-based wager game that limits players to a set number of attempts in a bonus round, a similar scenario exists in other skill-based wager games, like poker, bingo, and blackjack. The present invention addresses this by providing a bonus feature in which the player can continue playing the bonus round after the available attempts have been exhausted.

SUMMARY OF THE INVENTION

The present invention permits a player to re-buy attempts for a bonus round in a wager game, such as a traditional slot game or a skill-based wager game. The embodiments presented below are shown for a skill-based game but the present invention can be implemented with a traditional slot game as well. The bonus round may be either an RNG bonus round or a skill-based bonus round. In a RNG bonus round, the player is rewarded a variable amount of bonus points, often revealed by an animation. In a skill-based bonus round, the player accrues points by participating in a game in which the player's use of skill, knowledge, or strategy would improve the probability of achieving that game's desired outcome.

When a bonus is triggered in the skill-based wager game, the player enters the bonus round and is given the option to purchase attempts. In certain embodiments, the player is given a variable number of attempts for free. At certain instances during the bonus round, the player can re-buy attempts using some form of consideration, often credits that are currently on the gaming machine. Thus, the player can continue participating in the bonus round until, for example, the bonus round is complete, the player declines to re-buy attempts, the player chooses to exit the bonus round, or the player depletes the available consideration. Following one of these, or similar, occurrences, the player returns to the skill-based wager game.

DETAILED DESCRIPTION

As used herein, the term "skill-based" designates that a player's use of skill, knowledge, or strategy in a game would improve the probability of achieving that game's desired outcome. The term "bonus round" refers to either an RNG bonus round, in which the player receives a variable amount of points that is often revealed to the player through a graphical animation, or a skill-based bonus round, in which the player must perform some skill-based task to achieve an objective. The term "wager" refers to the amount of credits that the player places as a bet on a round of the skill-based wager game, deducted from the player's credit balance.

The term "consideration" is a broad term that encompasses many different ways to participate in a traditional wager or skill-based wager game. Consideration often includes, but is not limited to, monetary payments. By way of example, the player could insert typical payment methods for consideration, like cash, change, or a credit card. One of ordinary skill in the art would appreciate that consideration could extend to other forms of monetary payment. The player could also insert tokens or cards pre-loaded with monetary value provided, for example, by the establishment in which the game resides. Consideration could further involve the establishment pre-loading the gaming machine via a central server upon receipt of monetary payment at a remote desk. Consideration also encompasses non-monetary options. Consideration could be awarded to a player upon filling up a "win meter" by playing the skill-based wager game or other games in an establishment. Consideration could further be the act of pressing a button or portion of a touch screen to start the game, in the case of a personal gaming machine or free-to-play mobile game.

Figure 1:
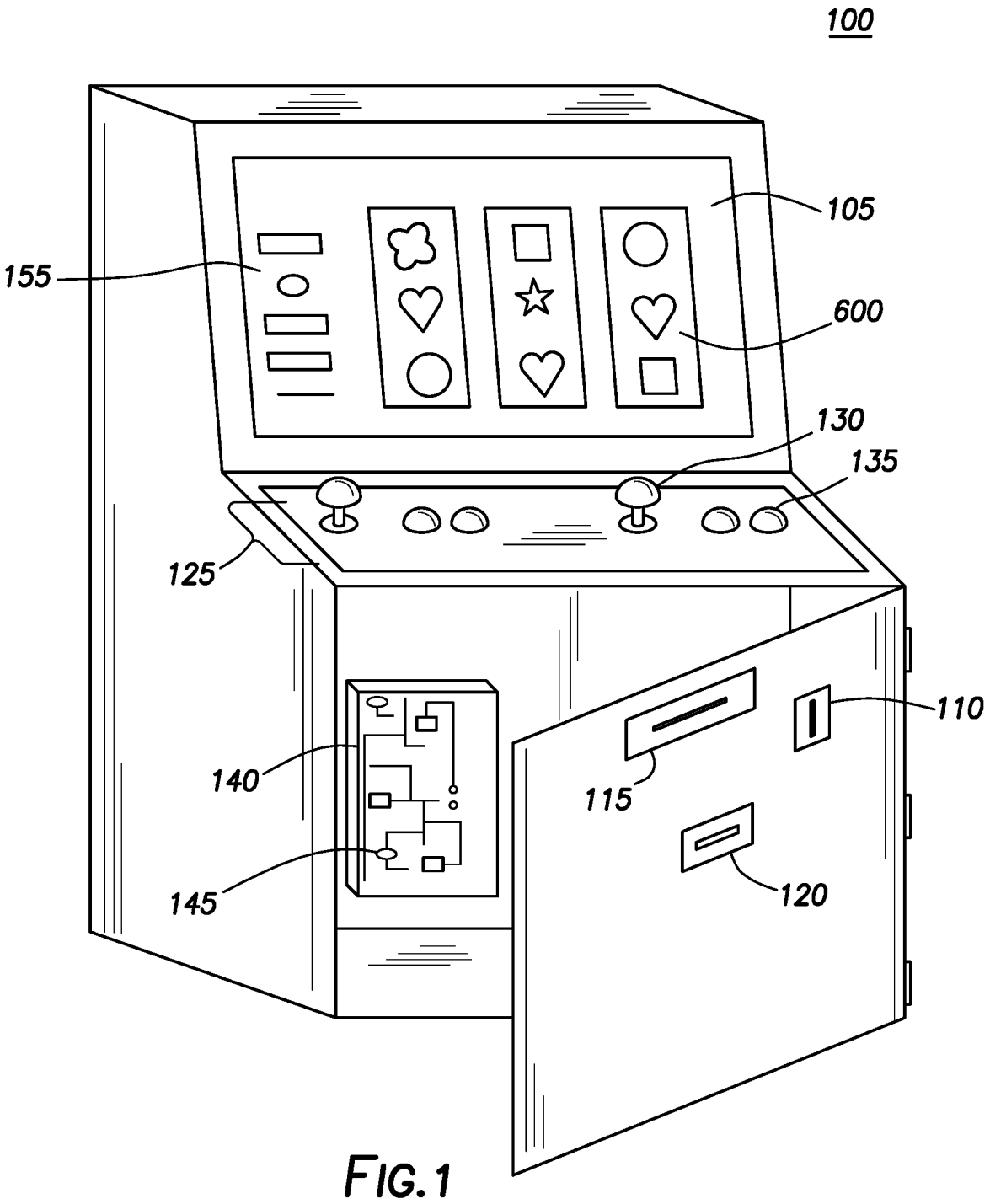
FIG. 1 illustrates one embodiment of a gaming machine for use in playing a skill-based wager game with a re-buy bonus feature.

FIG. 1 shows one embodiment of a gaming machine 100 for use in playing a skill-based wager game with a re-buy bonus feature. The gaming machine 100 is composed of one or more monitors or mechanical interfaces 105 to display elements of the skill-based wager game. An example of a mechanical interface is a physical reel with symbols imprinted on it for use in a slot-machine game. By way of example, elements of the skill-based wager game that may be displayed on the one or more monitors or mechanical interfaces 105 may include the skill-based wager game itself 600, components and information pertaining to the skill-based wager game 155, the bonus round, and components and information pertaining to the bonus round. The one or more monitors or mechanical interfaces 105 may also display a bingo board to satisfy class II casino game requirements.

Consideration is used to play the skill-based wager game. Consideration may be deposited in a coin slot 110, a bill acceptor 115, or some other device that permits the transfer of consideration to the gaming machine 100. By way of example, other devices that convert consideration into in-game credits could include a credit card scanner, a ticket scanner, or a connection to a central host 285 that assigns credits to a gaming machine 100.

The player may receive rewards depending on the player's success in the skill-based wager game. In this embodiment, rewards that are given to the player are tickets, distributed via a ticket dispenser 120. However, the reward given to the player can vary, in which case some other reward dispensing device would be sufficient.

To interact with and play the skill-based wager game, the player manipulates one or more input devices 125. The type and number of input devices 125 can vary. Input devices 125 may include, but are not limited to, joysticks 130, mechanical buttons 135, or a combination of input devices 125. In another embodiment of the gaming machine 100, a touch-screen may be used as an input device 125.

Figure 2A:
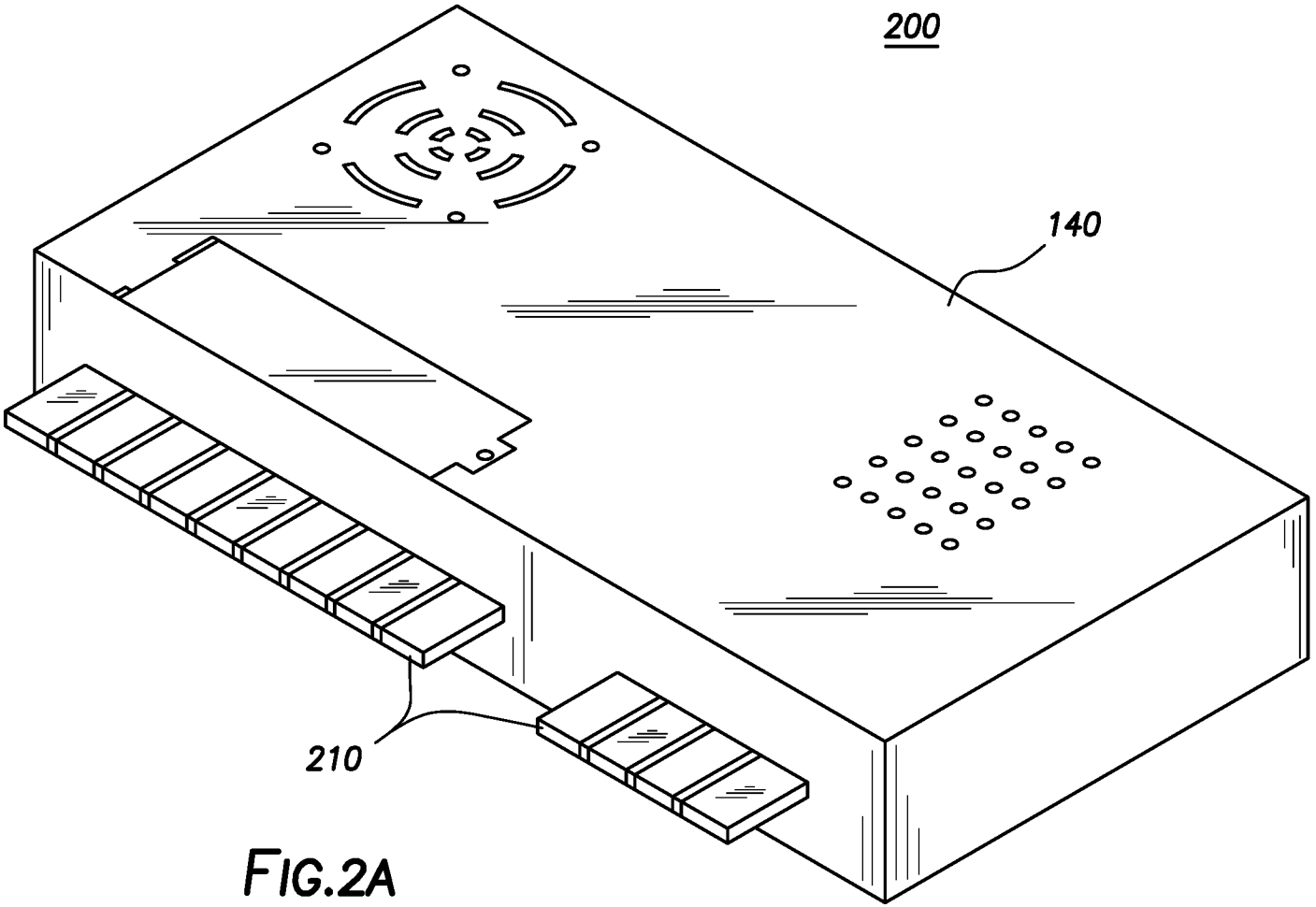
FIG. 2A illustrates a logic box that is used to implement and operate a skill-based wager game with a re-buy bonus feature.
Figure 2B:
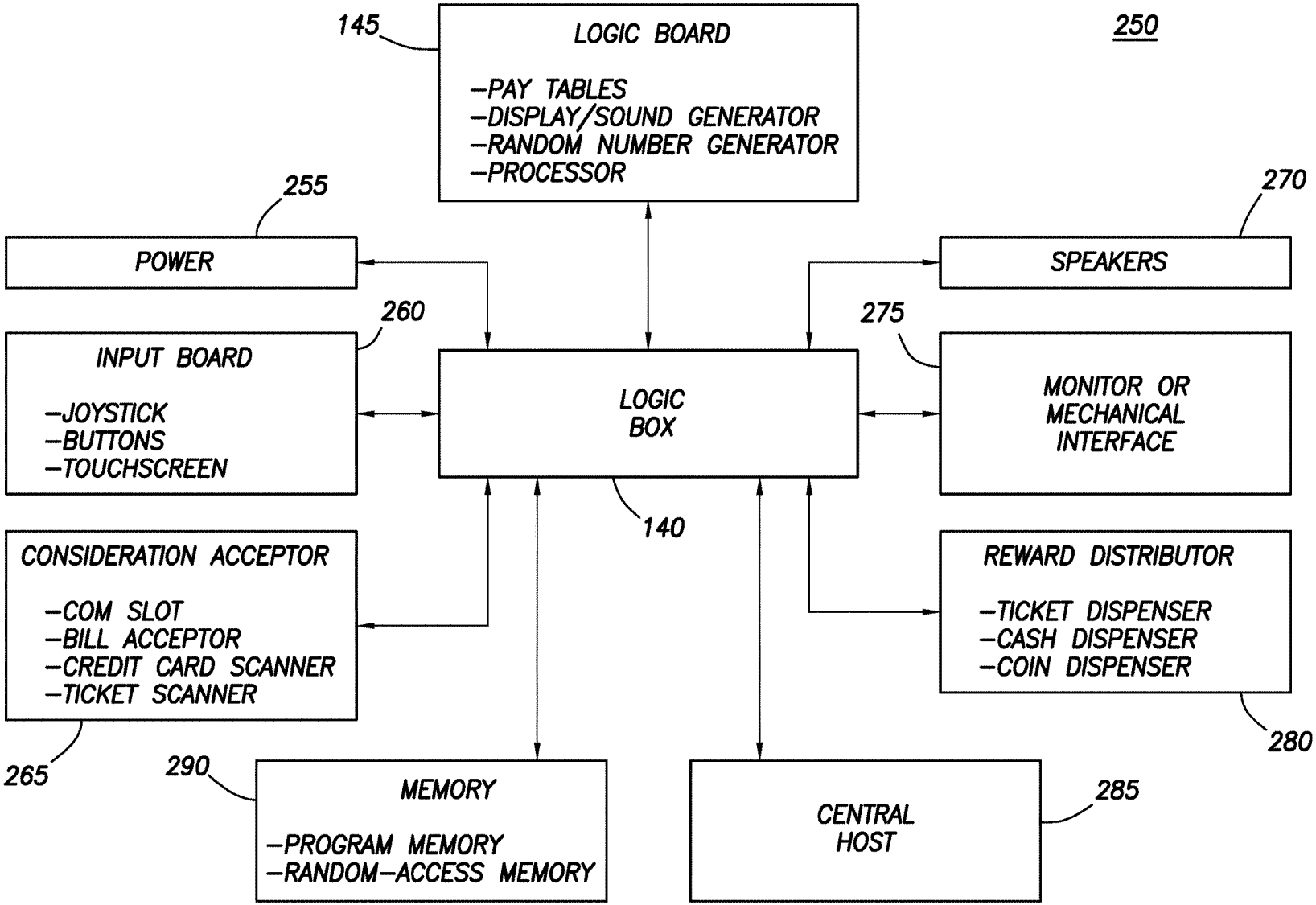
FIG. 2B is a diagram of the logic box, its connections, and its internal components.

A logic box 140 contains a logic board 145 that operates the gaming device 100 via a software program, described further in FIGS. 2A-2B.

FIG. 2A shows a logic box 140 that is used to operate and implement the skill-based wager game with a re-buy bonus feature. The logic box contains a logic board 145, which handles the math and logic of the skill-based wager game and bonus round, described further in FIG. 2B. The logic box 140 contains input and output connections 210 to communicate with external devices, like the gaming machine's display, speakers, or the central host in an establishment.

FIG. 2B is a diagram detailing a logic box 140, its connections, and its internal components. The logic box 140 and its internal components are powered by a power supply 255. The logic box 140 contains a logic board 145. The logic board 145 comprises elements that assist with the operation of the skill-based wager game. The logic board 145 may include, by way of example, one or more processers, a sound and display generator, a random number generator, and a pseudo-random number generator. The processor analyzes inputs received from the input connections 210 and produces outputs that it relays to the output connections 210. The random number generator and pseudo-random number generator assist with randomized (or pseudo-randomized) elements of the skill-based wager game. Randomized elements or pseudo-randomized elements may include the pattern of symbols that results from a spin in a slot-machine game or the amount of points awarded in an RNG bonus round. The logic board 145 can be programmed to satisfy the bingo and math requirements of a class II casino game according to regulations set forth by organizations such as the National Indian Gaming Commission. The logic board 145 could also be programmed without these requirements so that the skill-based wager game operates as a typical amusement game.

The logic board 145 receives a variety of signals sent by inputs connected to the logic box 140. The input board 260 captures inputs that the player uses to play the skill-based wager game. Information regarding consideration is sent via some form of a consideration acceptor 265. The logic board further communicates with a variety of output devices, from speakers 270 to a monitor or a mechanical interface 275 to some form of a reward distributor 280. In some embodiments, the logic board 140 communicates with other machines, often a central host 285 via a network card. By way of example, the network card could allow the gaming machine 100 to comply with certain state regulations that require the gaming machine 100 to connect to a central host 285 owned by the state. In another embodiment, the gaming machine 100 may be connected to other gaming machines 100 to allow for cluster gaming. A simple network diagram is provided in FIG. 8. The gaming machine 100 may also operate as a standalone device.

The logic box 140 further contains memory 290. Program memory is used to store the program that operates the gaming machine 100. By way of example, program memory can be a disk drive or non-computer-based memory. Program memory may contain information like the pay table that the skill-based wager game uses and the probabilities of certain events. Random-access memory (RAM) is distinct from program memory and is used to facilitate the operation of the gaming machine 100.

In certain example embodiments the memory 290 is tangible and non-transitory. The terms "tangible" and "non-transitory," as used herein, are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

Figure 3:
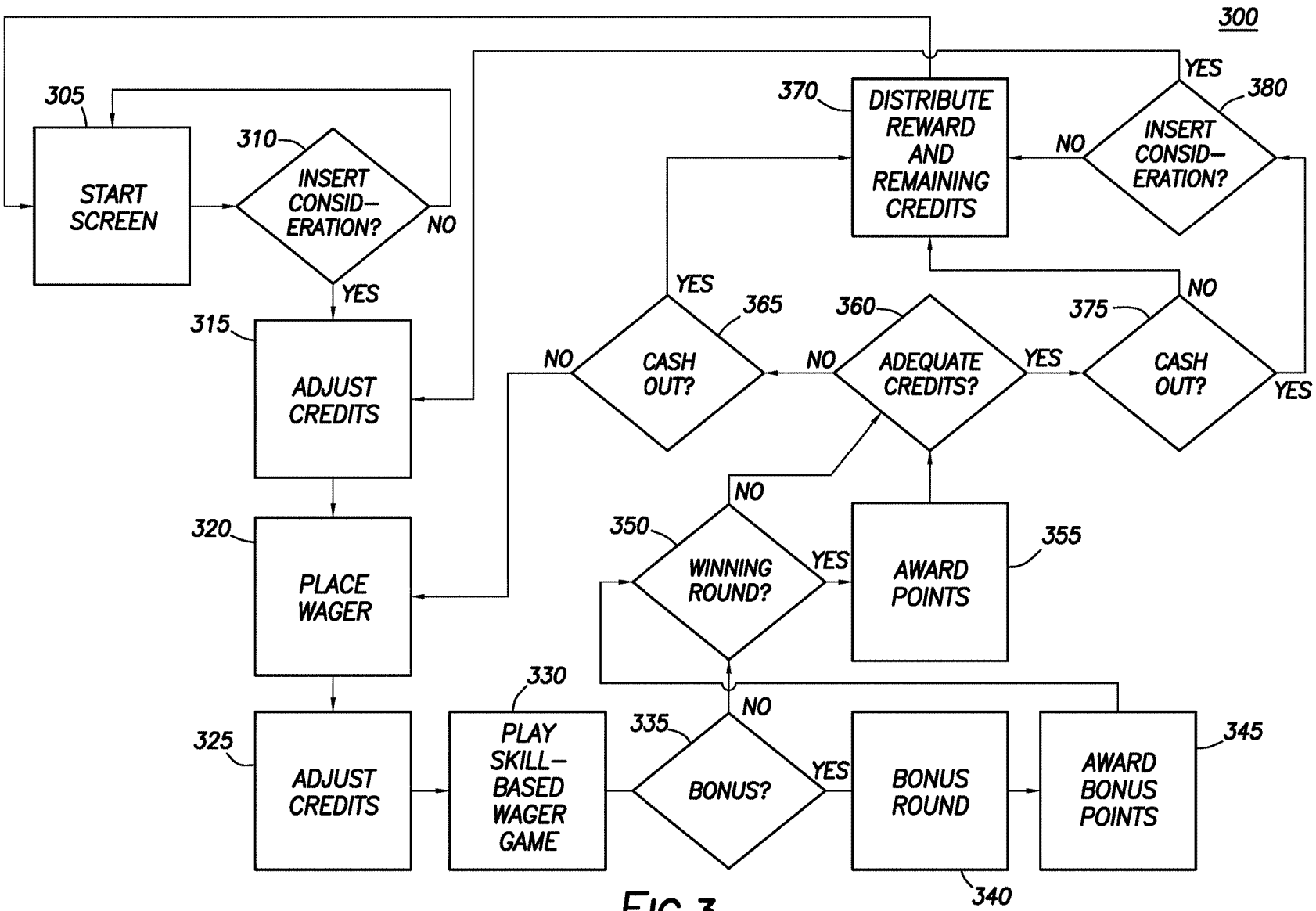
FIG. 3 is a flowchart that describes the operation of a skill-based wager game.

FIG. 3 is a flowchart of the operation of the skill-based wager game, shown generally at 300. The game defaults to a start screen (block 305). The player begins the game by inserting some form of consideration (block 310). The gaming machine 100 converts the consideration into credits to be used in the skill-based wager game and adjusts the player's credits accordingly (block 315). The player places a wager on the round of the skill-based wager game that is to be played (block 320). The gaming machine 100 adjusts the player's credits accordingly (block 325). The player then plays a round of the skill-based wager game (block 330). In certain example embodiments, the skill-based wager game takes a variety of forms. By way of example, the skill-based wager game could be a slot game that allows players to nudge certain reels to reach a desired outcome. Traditional wager games can include the slot machine, in mechanical, electromechanical, or electronic form, in which the player initiates the spinning of reels, for example, by pulling a lever or pressing a SPIN button.

Following a round of the skill-based wager game, the system checks to see if a bonus round is triggered 335. In certain example embodiments, a bonus round is triggered in a variety of ways. In certain example embodiments, a bonus round is triggered by accomplishing an objective in the skill-based game or by progressively filling up a bonus meter in the skill-based game. A bonus round could further be randomly or pseudo-randomly awarded. If a bonus round is triggered (block 335), then the bonus round (block 340) operates as described in FIGS. 4A-4B, and bonus points are awarded to the player (block 345). The system checks if the player won the skill-based wager game round (block 350). If the skill-based wager game round is won, the player is awarded points (block 355).

Following the bonus round, the gaming machine 100 checks the number of credits available (block 360). If the credits available are insufficient to play another game, the player has the option to "cash out" and redeem the points accrued in the skill-based wager game into some form of a reward (block 375). If the player chooses to cash out, the player may be given a reward (block 370). The reward could be anything from a monetary award to a chance to insert the player's name on a high score screen. If the player does not choose to cash out, the player is prompted to insert further consideration (block 380). Should the player not insert further consideration at block 380, the player may be given a reward (block 370). If the player inserts further consideration at block 380, the player's credits are adjusted accordingly (block 315) and the gaming cycle continues.

On the other hand, if the player's credits are sufficient, the player has the option to cash out (block 365). If the player chooses to cash out, the player may be given a reward depending on the points the player has accrued (block 370). Upon cashing out, the system returns to the start screen (block 305). If the player does not choose to cash out at block 365, then the player is prompted to place a wager (block 320) and the gaming cycle continues.

Figure 4A:
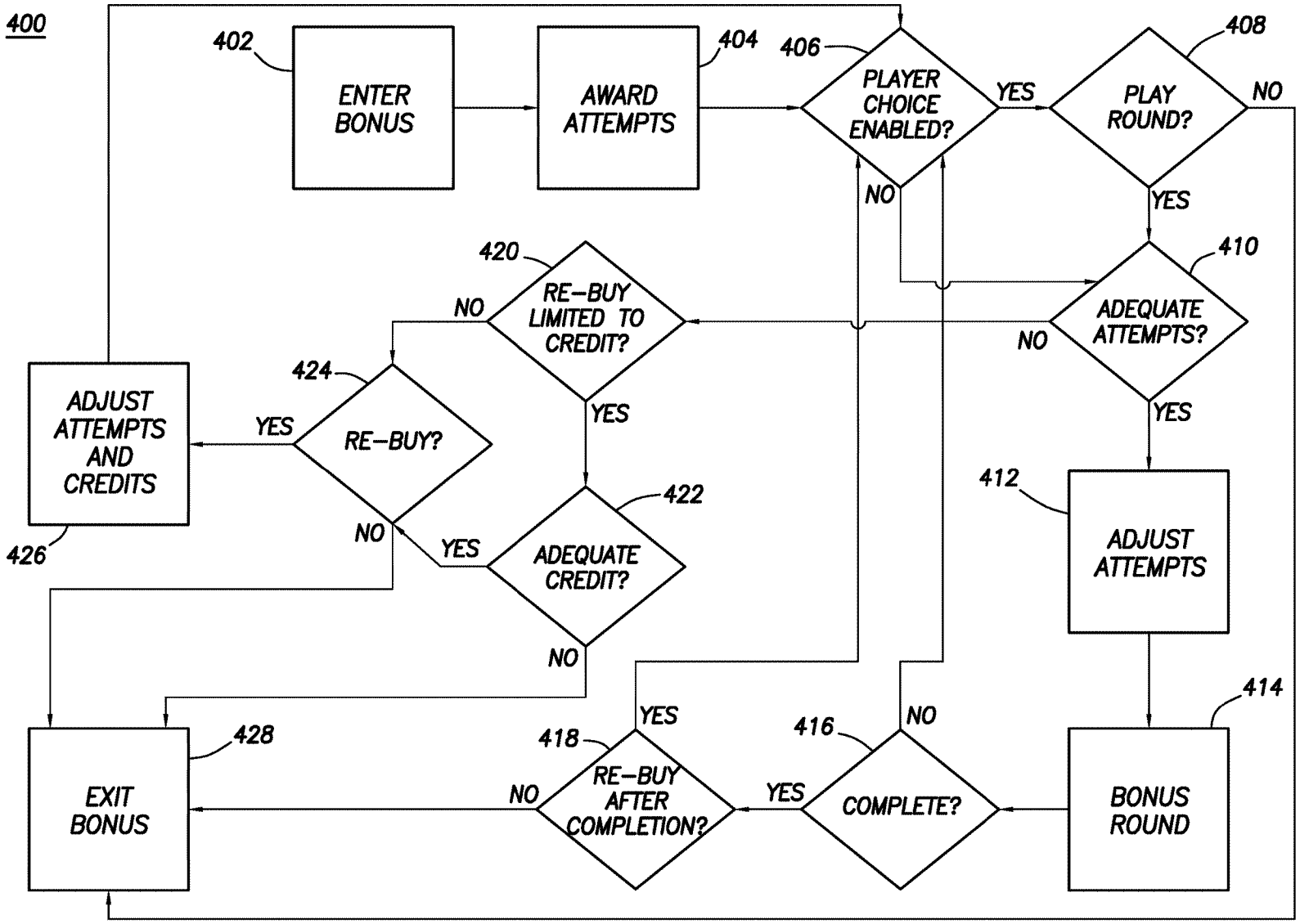
FIG. 4A is a flowchart that describes the operation of a bonus round in which attempts are initially awarded to the player.

FIG. 4A is a flowchart of one embodiment of the operation of the bonus round in which attempts are initially awarded to the player, shown generally at 400. Upon entering the bonus round (block 402), the player is awarded an initial number of attempts (block 404). In some embodiments, the player has the option to choose (block 406) whether to play the bonus round (block 408) or forgo the remaining attempts and exit the bonus round (block 428). In other embodiments, the player does not have that option to choose whether or not to play the bonus round at block 406.

While the player's remaining number of attempts allows the player to continue with the bonus round 410, the player's remaining number of attempts is adjusted (block 412) and the player is presented with the bonus round (block 414). In some embodiments, if the player completes the bonus round (block 416), then the player exits the bonus round and returns to the original skill-based wager game (block 428). In other embodiments, the player may have the option to re-buy attempts (block 418) upon completion of the bonus round (block 416). The system reverts back to the step that determines whether the player has the option to choose to play the bonus round (block 406) and continues the cycle.

If the player runs out of attempts in block 410, the player is presented with the option to re-buy attempts. In some embodiments, the player may be limited to purchasing attempts with available credit on the machine (block 420). In that embodiment, the system check whether the player has credits available (block 422) before prompting the player to re-buy attempts (block 424) and continue the bonus round. If the player chooses to re-buy attempts in block 424, the credits used are converted into attempts (block 426). If the player chooses to not re-buy attempts in block 424 or if the player does not have credits available in block 422, then the player exits the bonus round and returns to the original skill-based wager game (block 428). In other embodiments, the player is not limited to purchasing attempts with available credit on the machine (block 420). In those embodiments, the player can insert further consideration to re-buy attempts (block 424). The system then adjusts the player's attempts and credits accordingly (block 426). In other embodiments, the cost to re-buy bonus attempts may be fixed or variable. The variability can depend, for example, on the number of times that the user has previously attempted to re-buy, but it is not intended to be limited to only this variability.

One of ordinary skill in the art would appreciate that the re-buy bonus feature (block 424) need not be triggered by inadequate attempt count. In another embodiment of a bonus round, the re-buy bonus feature (block 424) could be ever-present; the player could choose to re-buy attempts before the player runs out of attempts.

Figure 4B:
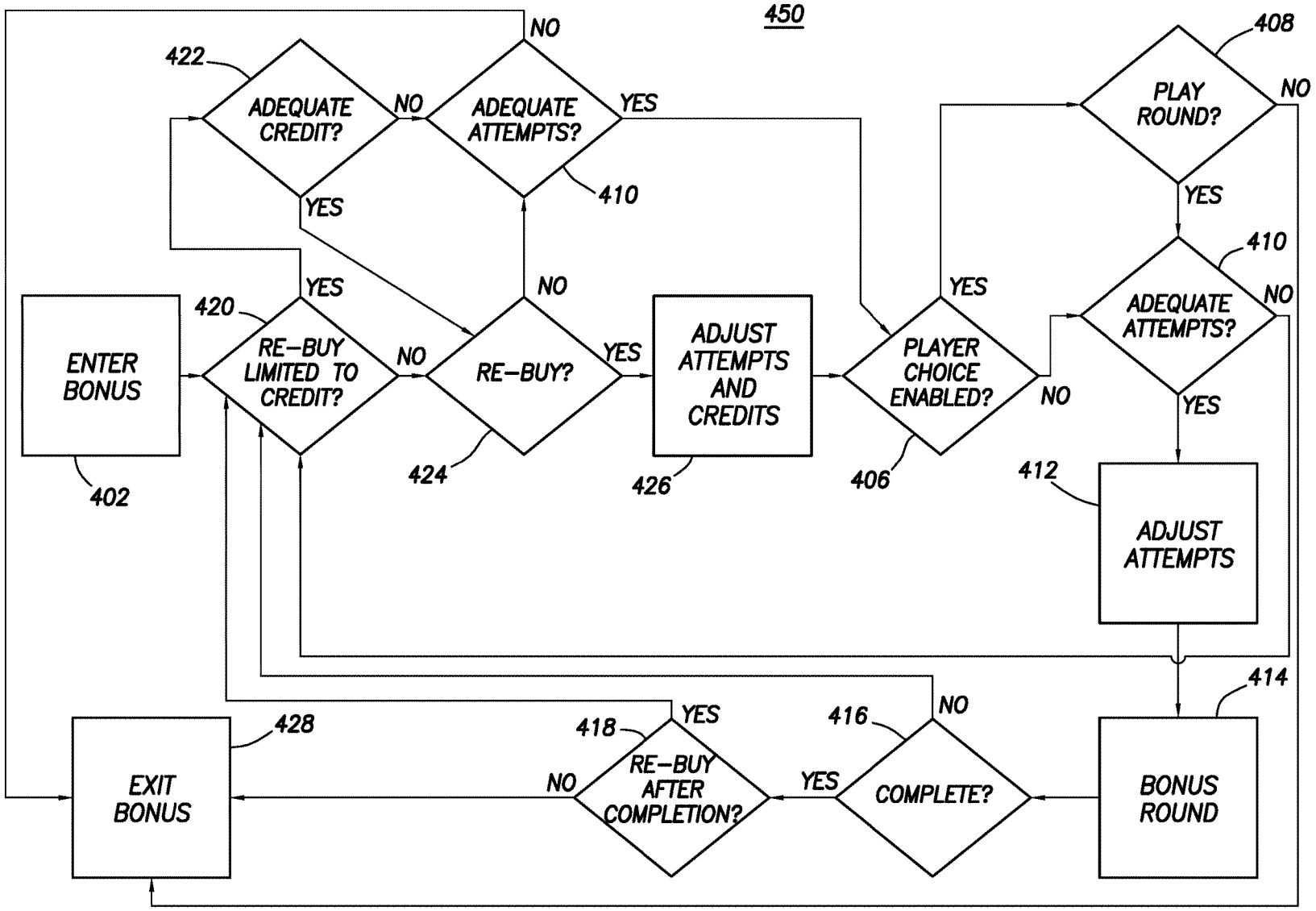
FIG. 4B is a flowchart that describes the operation of a bonus round in which attempts are not initially awarded to the player.

FIG. 4B is a flowchart of one embodiment of the operation of the bonus round in which attempts are not initially awarded to the player, shown genially at 450. Upon entering the bonus round (block 402), the player must buy attempts. In some embodiments, the player may be limited to purchasing attempts with available credit on the machine (block 420). In that embodiment, the system check whether the player has credits available (block 422) before prompting the player to re-buy attempts (block 424) and continue the bonus round. If the player chooses to re-buy attempts (block 424), the credits used are converted into attempts (block 426). If the player chooses to not re-buy attempts in block 424 or if the player does not have adequate credits available (block 422), then the system checks to see if the player has adequate attempts to continue playing the bonus round (block 410). If the player does not have adequate attempts to continue playing the bonus round in block 410, the player exits the bonus round and returns to the original skill-based wager game (block 428). In other embodiments, the player is not limited to purchasing attempts with available credit on the machine (block 420). In those embodiments, the player can insert further consideration to re-buy attempts (block 424). The system then adjusts the player's attempts and credits accordingly (block 426).

In certain embodiments, if player choice is enabled (block 406), the player has the option to choose whether to play the bonus round (block 408) or forgo the remaining attempts and exit the bonus round (block 428). In other embodiments, the player does not have that option to choose (block 406). While the player's remaining number of attempts allows the player to continue with the bonus round (block 410), the player's remaining number of attempts is adjusted (block 412) and the player is presented with the bonus round (block 414). In some embodiments, if the player completes the bonus round (block 416), then the player exits the bonus round and returns to the original skill-based wager game (block 428). In other embodiments, the player may have the option to re-buy attempts (block 418) upon completion of the bonus round (block 416). In those embodiments, the system reverts back to the step that determines whether the player is limited to re-buying attempts with the player's available credits (block 420) and continues the cycle.

Figure 5:
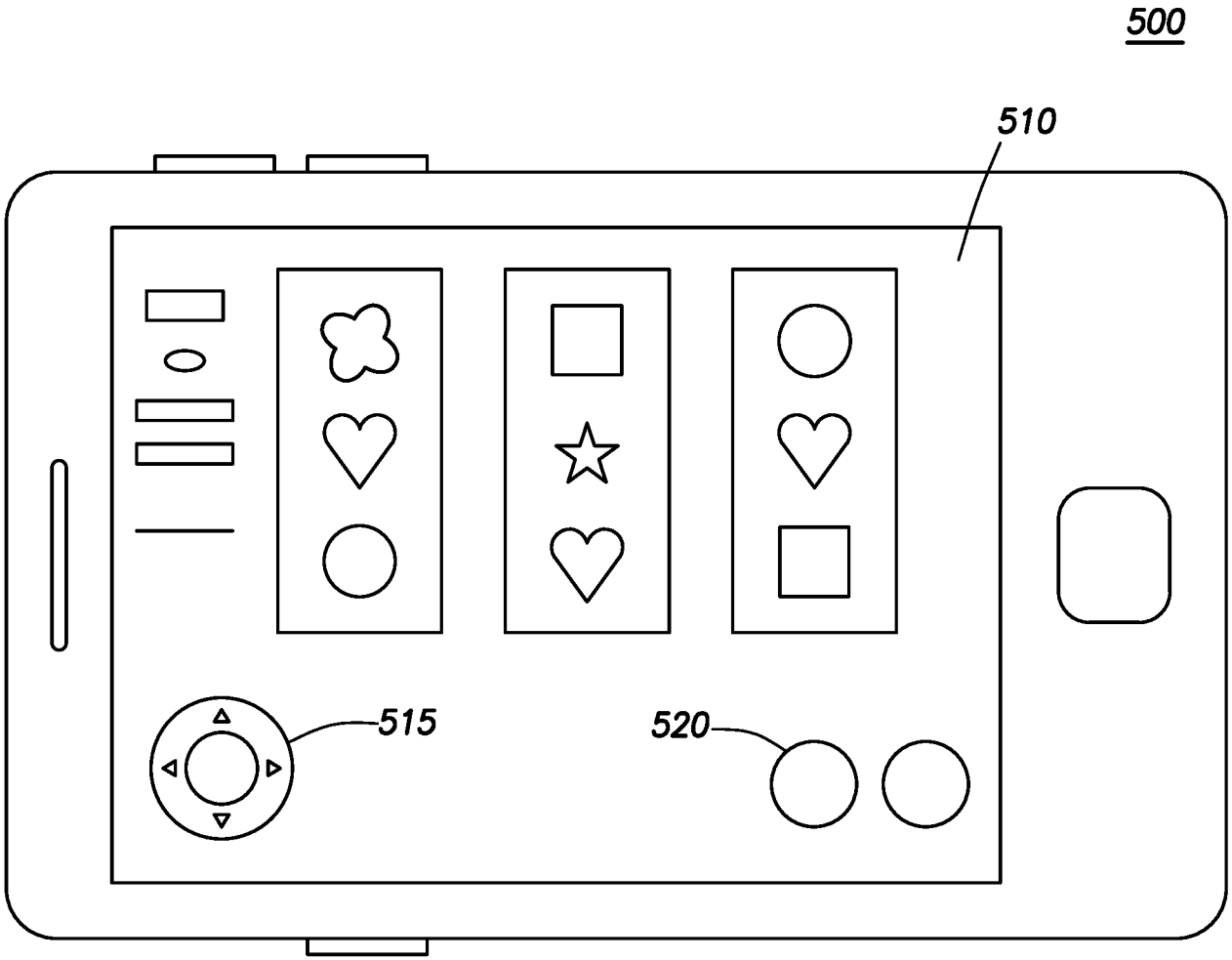
FIG. 5 illustrates one embodiment of a wireless handheld personal electronic device for use in playing a skill-based wager game with a re-buy bonus feature.

FIG. 5 shows one embodiment of a wireless handheld personal electronic device 500 for use in playing a skill-based wager game with a re-buy bonus feature. The skill-based wager game is displayed on the wireless handheld personal electronic device's touchscreen 510. To interact with and play the skill-based wager game, the player transfers physical actions into game inputs via the wireless handheld personal electronic device's touchscreen 510. The type and number of input methods can vary, including but not limited to electronic joysticks 515, electronic buttons 520, undesignated touch areas (for example, simply touching any portion of the touchscreen could initiate the spinning of the reels), or a combination of input methods.

One of ordinary skill in the art would appreciate that the wireless handheld personal electronic device would handle the processes typically reserved to the logic board in a gaming machine. By way of example, the wireless handheld personal electronic device would be programmed to use a random number generator or a pseudo-random number generator, store information like pay tables and the probability of events, and process player inputs. Inserting consideration would further be handled by typical wireless handheld personal electronic device methods, including, but not limited to, monetary consideration via credit card and non-monetary consideration via touching the start screen.

Figure 6:
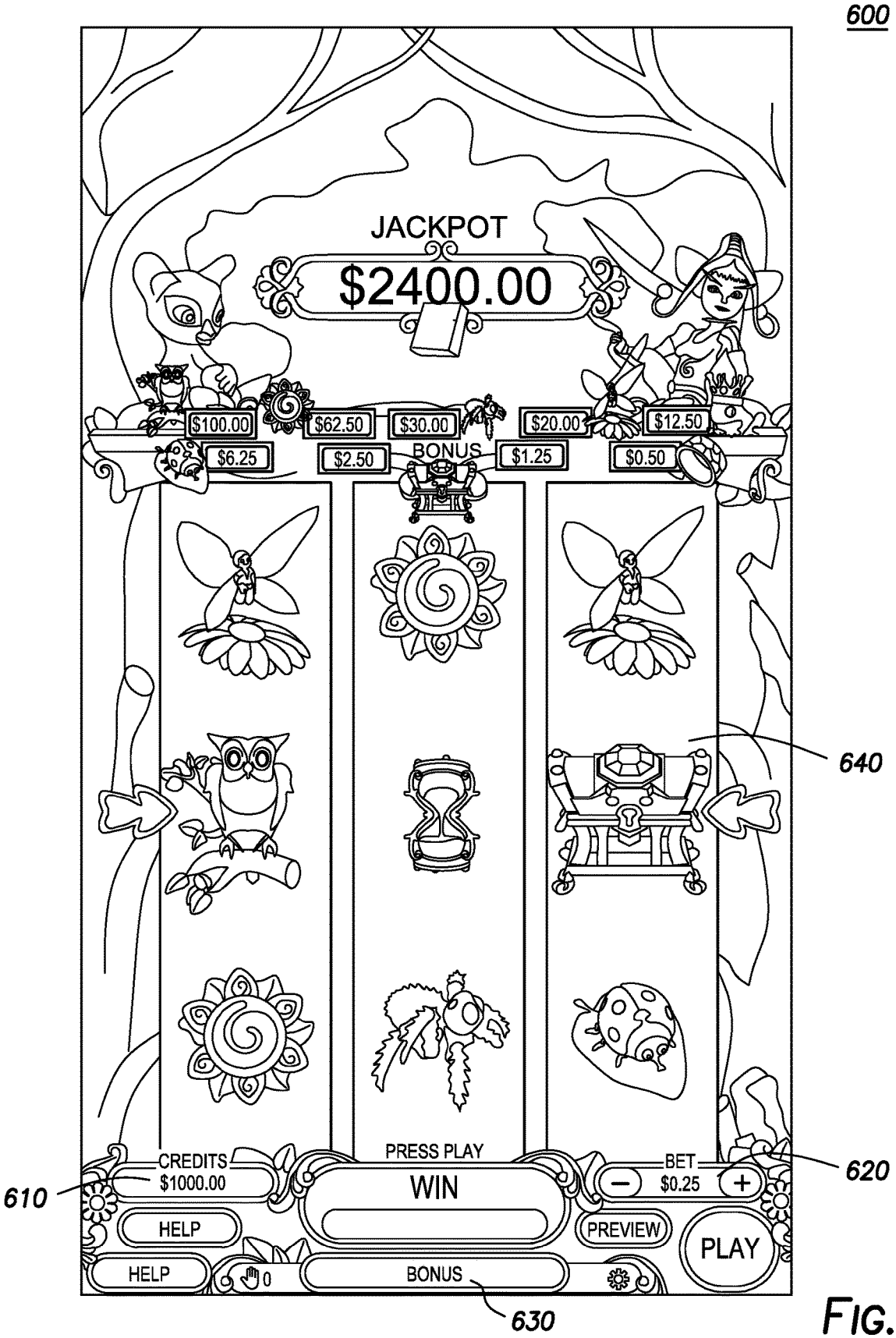
FIG. 6 illustrates one embodiment of a skill-based wager game.

FIG. 6 shows a screen shot of one embodiment of a skill-based wager game with a re-buy bonus feature. To play the skill-based wager game, the player inserts consideration that is converted into credits 610. Those credits 610 are then used to participate in the skill-based wager game by placing a bet 620 on the forthcoming round of the skill-based wager game. In this embodiment, the bonus round is triggered by progressively filling up a bonus meter 630. To fill the bonus meter 630, the player must receive a bonus symbol 640 on a reel along a pay line.

Figure 7:
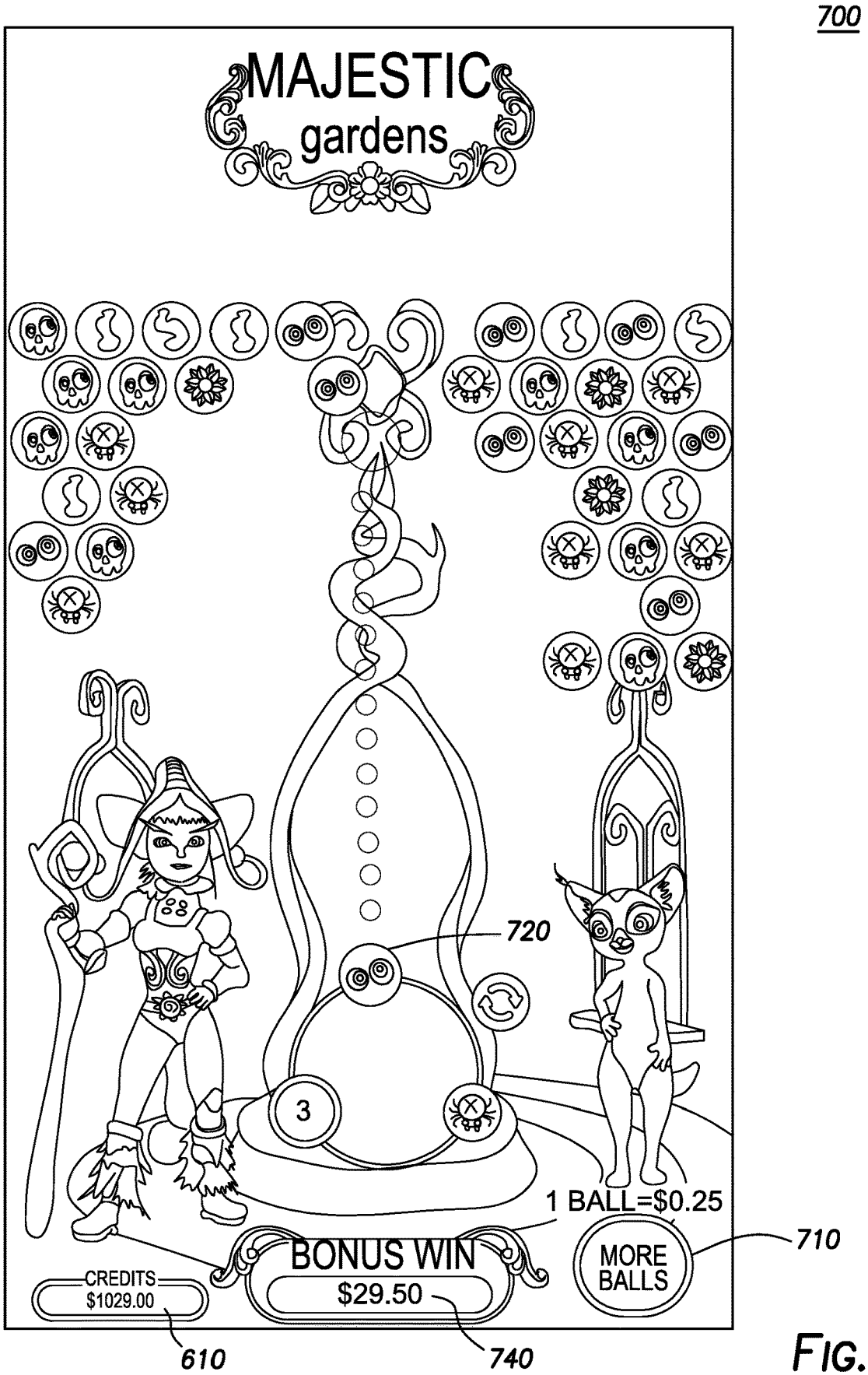
FIG. 7 illustrates one embodiment of a bonus round with a re-buy bonus feature.

FIG. 7 shows a screen shot of one embodiment of a skill-based bonus round 700 with a re-buy bonus feature 710. The re-buy bonus feature 710 converts credits 610 into attempts 720, giving the player additional chances to complete the skill-based bonus round 700 and accrue a greater bonus reward 740.

Figure 8:
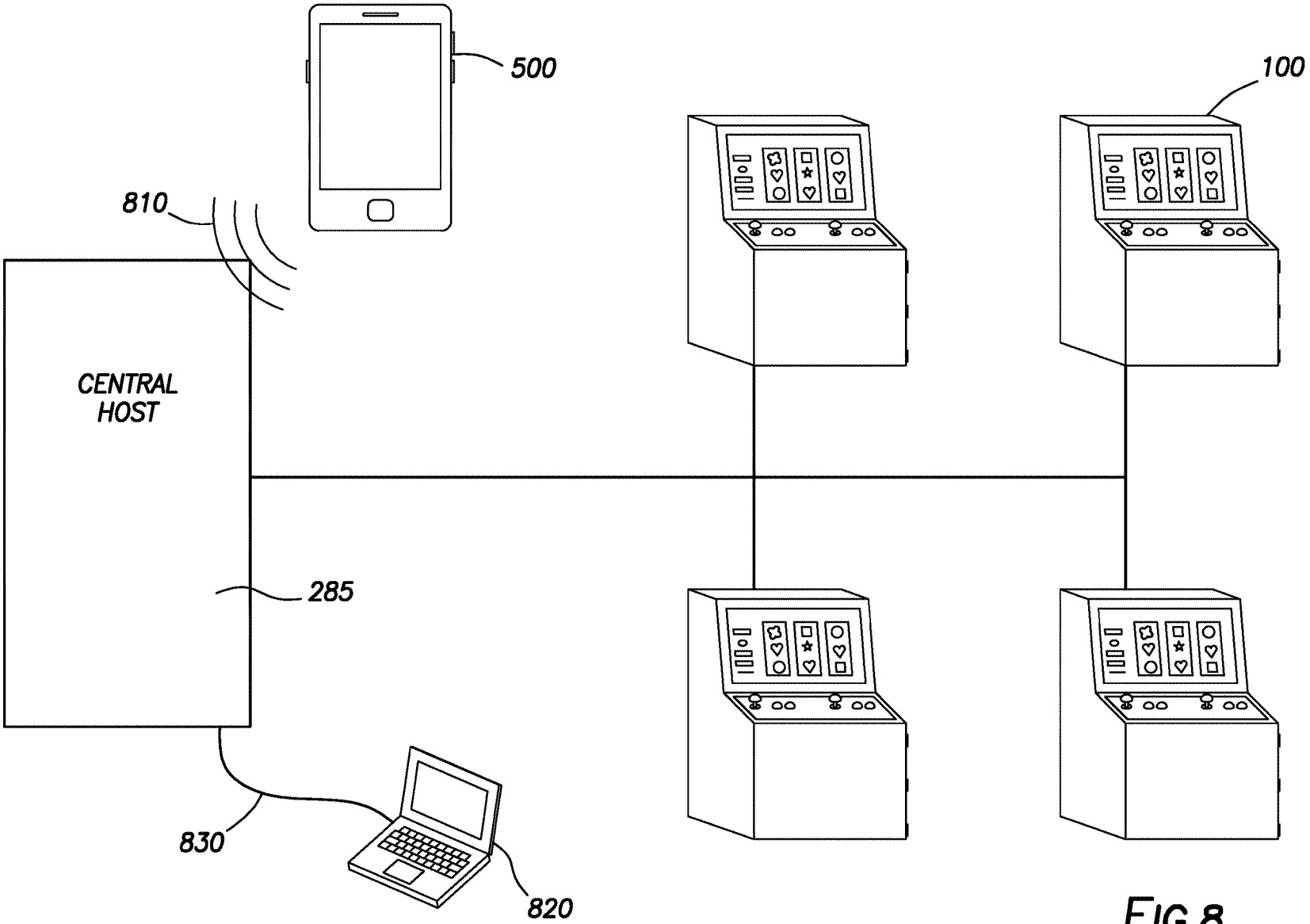
FIG. 8 illustrates a simple network diagram.

FIG. 8 is a diagram of one embodiment of a simple network 800. In this embodiment, a central host 285 controls the major operations of the network. The host may be accessed wirelessly 810, for example, by a wireless handheld personal electronic device 500. The host may further be accessed via a wired connection 830, for example, by a personal computer or laptop 820. The central host is connected to a plurality of gaming machines 100 through a wireless or wired connection. The gaming machines 100 may further be connected directly to other gaming machines 100.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a tangible computer readable storage medium or any type of media suitable for storing electronic instructions, and coupled to a computer system bus. Furthermore, any computing systems referred to in the specification may include a single processor or may be architectures employing multiple processor designs for increased computing capability.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims. Moreover, while the present disclosure has been described with respect to various embodiments, it is fully expected that the teachings of the present disclosure may be combined in a single embodiment as appropriate.

What is claimed is:

1. A method for providing a bonus feature in a wager game, comprising:

beginning play of a wager game when a player places a wager from a credit balance;

determining whether to trigger a bonus round;

during the bonus round:

determining a remaining number of attempts to continue play of the bonus round;

at any point during the bonus round while the remaining number of attempts is adequate to continue playing the bonus round, receiving, by a touchscreen, a first input from the player;

in response to the first input, determining whether the player has an adequate remaining credit balance to convert credit from the credit balance into a first additional number of attempts to continue play of the bonus round;

in response to determining that the player has an adequate remaining credit balance, adding the first additional number of attempts to the remaining number of attempts;

receiving, by a joystick, a second input from the player;

receiving, by a mechanical button, a third input from the player;

determining, by a hardware random number generator on a logic board, an amount of points to be awarded during the bonus round;

updating the bonus round on the touchscreen based on the second and third inputs;

decrementing the remaining number of attempts in response to updating the bonus round; and after the remaining number of attempts are inadequate to continue playing the bonus round:

displaying a prompt on the touchscreen to the player to convert credit from the credit balance into a second additional number of attempts to continue play of the bonus round;

determining whether a fourth input from the player was received by the touchscreen after the prompt is displayed;

if the fourth input was received:

determining whether the player has an adequate remaining credit balance to convert credit from the credit balance into a second additional number of attempts to continue play of the bonus round; and in response to determining that the player has an adequate remaining credit balance, adding the second additional number of attempts to the remaining number of attempts; and if the fourth input was not received, exiting the bonus round.

2. The method of claim 1, further comprising receiving a fifth input by the joystick after adding the second additional number of attempts to the remaining number of attempts.

3. The method of claim 1, further comprising prompting the player to re-buy bonus round attempts after successfully completing the bonus round.

4. The method of claim 1, wherein the bonus is triggered by the player accomplishing an objective.

5. The method of claim 1, wherein the bonus is triggered at random, determining based at least in part on the output of a pseudo random number generator.

6. The method of claim 1, wherein the bonus is triggered by progressively contributing to a bonus meter.

7. The method of claim 1, further comprising awarding the player an initial number of attempts for the bonus round, where the remaining number of attempts is initially set to the initial number of attempts for the bonus round.

8. The method of claim 1, further comprising not awarding the player an initial number of attempts.

9. The method of claim 1, wherein the bonus round is a skill-based bonus round, where the player's use of skill, knowledge, or strategy would improve a probability of achieving that skill-based bonus round's desired outcome.

10. The method of claim 1, wherein the bonus round is an RNG bonus round, where the player is awarded a variable amount of bonus points upon triggering the bonus round.

11. The method of claim 1, further comprising providing the player an option to choose whether to play the bonus round or forgo the remaining attempts and exit the bonus round prior to each bonus round.

12. A system for providing a bonus feature in a wager game, comprising:

a touchscreen;

a joystick;

a mechanical button;

a hardware random number generator on a logic board configured to determine an amount of points to be awarded during a bonus round;

at least one processor; and a memory including non-transitory executable instructions that, when executed, cause the at least one processor to:

begin play of a wager game when a player places a wager from a credit balance;

determine whether to trigger the bonus round;

during the bonus round:

determine a remaining number of attempts to continue play of the bonus round;

at any point during the bonus round while the remaining number of attempts is adequate to continue playing the bonus round, receive, by the touchscreen, a first input from the player;

in response to the first input, determine whether the player has an adequate remaining credit balance to convert credit from the credit balance into a first additional number of attempts to continue play of the bonus round; and in response to determining that the player has an adequate remaining credit balance, add the first additional number of attempts to the remaining number of attempts;

receive, by the joystick, a second input from the player;

receive, by the mechanical button, a third input from the player;

update the bonus round on the touchscreen based on the second and third inputs;

decrement the remaining number of attempts in response to updating the bonus round; and after the remaining number of attempts are inadequate to continue playing the bonus round:

display a prompt on the touchscreen to the player to convert credit from the credit balance into a second additional number of attempts to continue play of the bonus round;

determine whether a fourth input from the player was received by the touchscreen after the prompt is displayed;

if the fourth input was received:

determine whether the player has an adequate remaining credit balance to convert credit from the credit balance into a second additional number of attempts to continue play of the bonus round; and in response to determining that the player has an adequate remaining credit balance, add the second additional number of attempts to the remaining number of attempts; and if the fourth input was not received, exit the bonus round.

13. The system of claim 12, further comprising the executable instructions to cause the at least one processor to receive a fifth input by the joystick after adding the second additional number of attempts to the remaining number of attempts.

14. The system of claim 12, further comprising the executable instructions to cause the at least one processor to prompt the player to re-buy bonus round attempts after successfully completing the bonus round.

15. The system of claim 12, wherein the executable instructions cause the at least one processor to trigger the bonus when the player accomplishes an objective.

16. The system of claim 12, wherein the executable instructions cause the at least one processor to trigger the bonus at random, determined based at least in part on the output of a pseudo random number generator.

17. The system of claim 12, wherein the executable instructions cause the at least one processor to trigger the bonus when a bonus meter is filled.

18. The system of claim 12, further comprising the executable instructions cause the at least one processor to award the player an initial number of attempts for the bonus round, where the remaining number of attempts is initially set to the initial number of attempts for the bonus round.

19. The system of claim 12, further comprising the executable instructions cause the at least one processor to not award an initial number of attempts to the player.

20. The system of claim 12, wherein the executable instructions cause the at least one processor to trigger a bonus round, where the player's use of skill, knowledge, or strategy would improve a probability of achieving that bonus round's desired outcome.

21. The system of claim 12, wherein the executable instructions cause the at least one processor to trigger an RNG bonus round, where the player is awarded a variable amount of bonus points upon triggering the bonus.

22. The system of claim 12, further comprising the executable instructions to cause the at least one processor to provide the player an option to choose whether to play the bonus round or forgo the remaining attempts and exit the bonus round prior to each bonus round.

23. A system for administering a re-buy bonus feature in a wager game, comprising:

an electronic device having at least one processor, a hardware random number generator on a logic board, a touchscreen, a joystick, and a mechanical button; and a memory including non-transitory executable instructions that, when executed, cause the at least one processor to:

begin play of a wager game when a player places a wager from a credit balance;

determine whether to trigger a bonus round;

during the bonus round:

determine a remaining number of attempts to continue play of the bonus round;

at any point during the bonus round while the remaining number of attempts is adequate to continue playing the bonus round, receive, by the touchscreen, a first input from the player;

in response to the first input, determine whether the player has an adequate remaining credit balance to convert credit from the credit balance into a first additional number of attempts to continue play of the bonus round; and in response to determining that the player has an adequate remaining credit balance, add the first additional number of attempts to the remaining number of attempts;

receive, by a joystick, a second input from the player;

receive, by a mechanical button, a third input from the player;

update the bonus round on the touchscreen based on the second and third inputs, wherein the hardware random number generator determines an amount of points to be awarded during the bonus round;

decrement the remaining number of attempts in response to updating the bonus round; and after the remaining number of attempts are inadequate to continue playing the bonus round:

display a prompt on the touchscreen to the player to convert credit from the credit balance into a second additional number of attempts to continue play of the bonus round;

determine whether a fourth input from the player was received by the touchscreen after the prompt is displayed;

if the fourth input was received:

determine whether the player has an adequate remaining credit balance to convert credit from the credit balance into a second additional number of attempts to continue play of the bonus round; and in response to determining that the player has an adequate remaining credit balance, add the second additional number of attempts to the remaining number of attempts; and if the fourth input was not received, exit the bonus round.

* * * * *